US007905364B2

(12) United States Patent
Pail

(10) Patent No.: US 7,905,364 B2
(45) Date of Patent: Mar. 15, 2011

(54) PRODUCT DISPLAY SYSTEM, METHOD AND APPARATUS

(76) Inventor: Opher Pail, New York, NY (US)

( * ) Notice: Subject to any disclaimer, the term of this patent is extended or adjusted under 35 U.S.C. 154(b) by 542 days.

(21) Appl. No.: 11/974,347

(22) Filed: Oct. 12, 2007

(65) Prior Publication Data

US 2008/0302741 A1 Dec. 11, 2008

Related U.S. Application Data

(60) Provisional application No. 60/942,428, filed on Jun. 6, 2007.

(51) Int. Cl.
*A47F 1/04* (2006.01)

(52) U.S. Cl. ..... 211/59.3

(58) Field of Classification Search ..... 211/7, 54.1, 211/57.1, 59.1, 59.2, 51, 59.3
See application file for complete search history.

(56) References Cited

U.S. PATENT DOCUMENTS 4,289,242 A * 9/1981 Kenyon ..... 211/4
4,474,300 A * 10/1984 Entis ..... 211/57.1
4,475,658 A 10/1984 Roberts
4,821,894 A 4/1989 Dechirot
4,836,390 A 6/1989 Polvere
4,869,376 A 9/1989 Valiulis et al.
5,114,021 A * 5/1992 Fredrickson ..... 211/54.1
5,190,186 A 3/1993 Yablans et al.
5,222,608 A 6/1993 Eklof et al.
5,413,229 A * 5/1995 Zuberbuhler et al. ..... 211/59.3
5,439,120 A 8/1995 Brozak
5,605,237 A * 2/1997 Richardson et al. ..... 211/59.3
5,641,077 A 6/1997 Tufano et al.
5,671,851 A 9/1997 Johnson et al.
5,906,283 A 5/1999 Kump et al.
6,131,748 A * 10/2000 Kawasaki et al. ..... 211/54.1
6,142,317 A * 11/2000 Merl ..... 211/59.3
6,464,089 B1 * 10/2002 Rankin, VI ..... 211/59.3
6,691,891 B2 * 2/2004 Maldonado ..... 221/279
6,769,552 B1 8/2004 Thalenfeld
6,772,888 B2 8/2004 Burke
6,820,754 B2 * 11/2004 Ondrasik ..... 211/59.3
6,866,155 B2 3/2005 Nagel
7,007,810 B2 * 3/2006 Huehner et al. ..... 211/57.1
7,178,678 B2 * 2/2007 Mansfield et al. ..... 211/7
7,195,123 B2 3/2007 Roslof et al.
(Continued)

*Primary Examiner* — Jennifer E. Novosad
(74) *Attorney, Agent, or Firm* — Tiajoloff and Kelly LLP

(57) ABSTRACT

A display apparatus comprises an elongate support member configured to support a plurality of packaged products thereon. A product pusher device is movably supported on the support member for forward and rearward movement along it. The product pusher device has a biasing mechanism therein that engages the support member and applies a relative force thereto from the pusher device such that the product pusher device engages a rearmost one of the plurality of packaged products and applies a pushing force thereto so as to move the packaged products forward towards the distal end of the support member. The biasing mechanism is completely supported in the product pusher device and moves therewith on the support member. The biasing mechanism may be a wheel rotatably supported in the product pusher device so as to engage with the support member and to rotate when the product pusher device moves along the support member, and a spring having one end thereof fixedly connected with a housing of the pusher device, and a second end thereof fixedly connected with the wheel so that the spring is charged when the pusher device is moved rearward and the spring urges the wheel to rotate to move the pusher device forward on the support member. A method for providing a display, including for a retrofit of existing displays, is also described.

21 Claims, 10 Drawing Sheets

U.S. PATENT DOCUMENTS

| | | | | |
|---|---|---|---|---|
| 7,347,335 | B2 * | 3/2008 | Rankin et al. | 211/59.3 |
| 7,404,494 | B2 * | 7/2008 | Hardy | 211/59.3 |
| 7,566,037 | B2 * | 7/2009 | Vogler | 248/220.31 |
| 2002/0148794 | A1 * | 10/2002 | Marihugh | 211/59.3 |
| 2005/0072747 | A1 | 4/2005 | Roslof et al. | |
| 2005/0199563 | A1 | 9/2005 | Richter et al. | |
| 2006/0163180 | A1 * | 7/2006 | Rankin et al. | 211/59.3 |
| 2006/0237381 | A1 * | 10/2006 | Lockwood et al. | 211/59.3 |
| 2006/0261016 | A1 * | 11/2006 | Magid | 211/57.1 |
| 2006/0273053 | A1 | 12/2006 | Roslof et al. | |
| 2008/0302741 | A1 * | 12/2008 | Pail | 211/59.3 |
| 2010/0012602 | A1 * | 1/2010 | Valiulis et al. | 211/59.3 |
| 2010/0078398 | A1 * | 4/2010 | Hardy | 211/59.3 |
| 2010/0089847 | A1 * | 4/2010 | Rataiczak et al. | 211/59.3 |

* cited by examiner

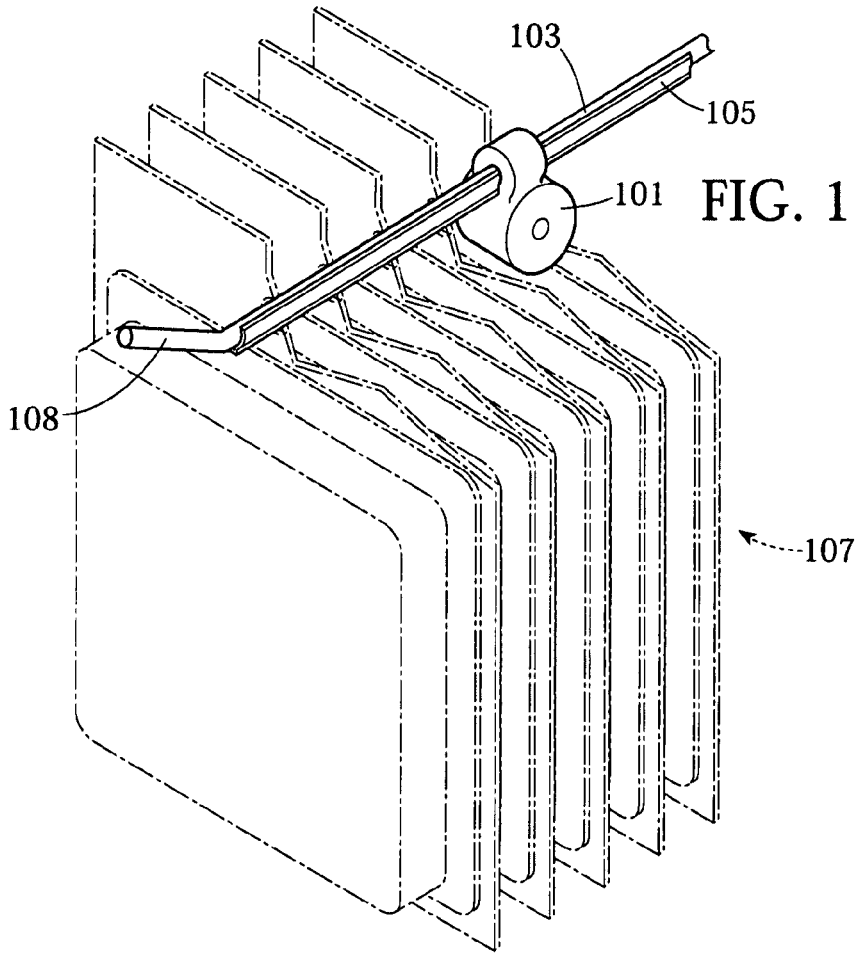
FIG. 11
FIG. 12
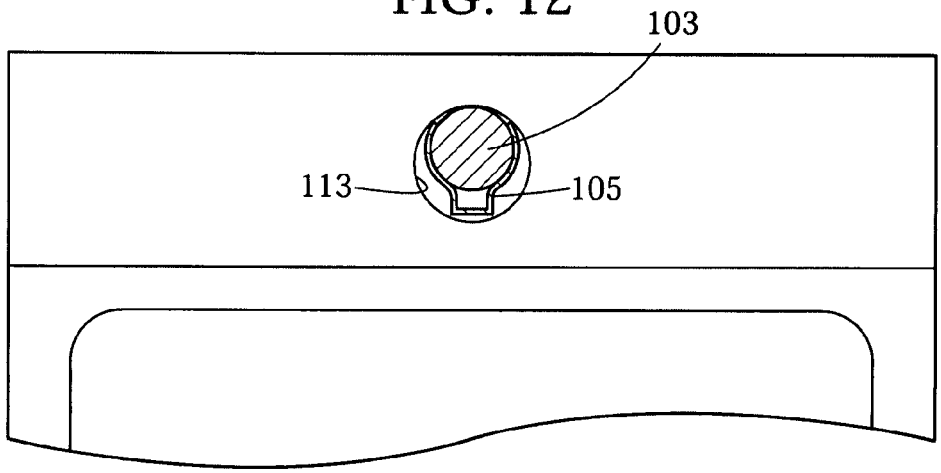

PRODUCT DISPLAY SYSTEM, METHOD AND APPARATUS

RELATED APPLICATION

This application claims the priority of U.S. provisional application Ser. No. 60/942,428 filed on Jun. 6, 2007.

FIELD OF THE INVENTION

The present invention relates to retail merchandise display, and, in particular, to devices that better display merchandise to customers by moving hanging items in a display towards the front end of a rod hook as some of the items are removed from the front end of the rod hook by customers for examination or purchase.

BACKGROUND OF THE INVENTION

In the field of retail merchandising, hooks or rods are often used to present products in an accessible and space-efficient manner. These retail displays typically consist of a board that is affixed to the wall or some other stationary surface of a store with a long, straight hook extending away from the wall towards customers. A number of products, usually all identical, are then hung on the hook, as is well known. To facilitate hanging, the packaging of merchandise intended for display by hanging often includes a hole located near the top of the package.

One problem associated with hook and board merchandise displays is the decrease in sales due to decreasing visibility of remaining merchandise items after the front packages have been removed from a hook. This lack of visibility stems from the fact that as items are removed by customers from the end of a hook, the remaining packages near the back end of the hook are often partially hidden from view.

In order to overcome such problems, stores frequently employ people that go through the store at the end of the day and move merchandise items displayed on a hook towards the front end of the hook (towards customers) after customers have removed items from the front end of the hook for purchase or examination.

Examples of mechanical product pushers currently known include that described in U.S. Pat. No. 5,222,608, which includes a push plate mounted on the hook, as well as a compression spring which wraps around the hook and sits in vertical orientation to the plate and the wall. The compression spring is provided to apply a force forward against the plate, thereby pushing products forward. This product is disadvantageous in that it is inefficiently constructed, unattractive and may be susceptible to breakage when products are pulled off the rod hook by customers.

Other systems, such as that described in U.S. Pat. No. 5,114,021, have an elongated spring that extends over the hook length and draws the packages on the hook to the front. In addition to being unattractive, the spring operation is complicated mechanically, and vulnerable to damage or malfunction. Also, the spring arrangement makes a rod hook that is wider than the conventional small circular hole used in most packages designed for hanging display.

SUMMARY OF THE INVENTION

It is accordingly an object of the present invention to provide an apparatus and method for maintaining products in a hanging display at the front of their display that does not have the drawbacks of the prior art.

An object of the present invention is to maintain packaged items in a neat and organized manner by uniformly displaying all products at the front of the display hooks and eliminating any spaces in-between items.

Another object of the package display apparatus of the present invention is to provide a more attractive system that is less susceptible to tampering or damage than any preexisting product pushers, by components contained in an outer housing and thereby hidden from view.

In accordance with an aspect of the present invention, a display apparatus comprises an elongate support member configured to support a plurality of packaged products thereon. The support member has a proximal end secured to a fixed display surface and extending generally horizontally and forwardly therefrom, and a distal end. A product pusher device is movably supported on the support member for forward and rearward movement therealong. The product pusher device has a biasing mechanism therein that engages the support member and applies a relative force thereto from the pusher device such that the product pusher device engages a rearmost one of the plurality of packaged products and applies a pushing force thereto so as to move the packaged products forward towards the distal end of the support member. The biasing mechanism is completely supported in the product pusher device and moves therewith on the support member.

In an aspect of the invention, the biasing mechanism may comprise a wheel rotatably supported in the product pusher device so as to engage with the support member and to rotate when the product pusher device moves along the support member, and a biasing element supported in the product pusher device. The biasing element is connected with the wheel so as to urge said wheel to rotate so as to move the pusher device forward relative to the support member. The biasing element preferably comprises a spring having an outer end thereof fixedly connected with a housing of the pusher device, and an inner end thereof fixedly connected with the wheel so that the spring is charged when the pusher device is moved rearward and the spring urges the wheel to rotate to move the pusher device forward on the support member.

In another aspect of the invention, a product pushing device is configured to be supported on a rod structure. The pushing device comprises a housing configured to have the rod structure extend therethrough, and a wheel rotatably supported in the housing in a position such that the wheel is in constant engagement with the rod structure when the rod structure extends through the housing. A force generating element is supported in the housing and connected with the wheel so as to urge the wheel to rotate in a direction.

In still another aspect of the invention, a method for displaying products configured for hanging display comprises providing an elongate member configured to support the products hanging thereon. The elongate member has a proximal end fixedly supported on a back wall of the display and a forwardly projecting distal end having a structure configured to provide a resistance to products sliding off said elongate member. The method also includes providing a pusher device supported on the elongate member. The pusher device has a housing rotatably supporting a wheel in constant engagement with the elongate member and a coil spring connected with the wheel so as to apply a rotational force to the wheel that causes the wheel to roll along the elongate member in a forward direction towards the distal end of the elongate member. The coil spring is charged when the pusher device is pushed back on the elongate member away from the distal end. The method also includes pushing the pusher device on the elongate member back away from the distal end and loading the products onto the elongate member between the pusher device and the distal end. The rotational force applied to the wheel by the coil spring of the pusher device is selected such that the wheel moves the pusher device forward and engages a rearmost of the products and pushes all of the products on the elongate member forward until a foremost of the products engages the structure of the distal end that provides the resistance, and such that the pusher device does not impart a force to said foremost product sufficient to overcome the resistance of the distal end and push the foremost product off the elongate member.

According to other preferred aspects of the apparatus or method of the invention, the wheel and the support rod or member both have friction enhancing surfaces where they engage each other, especially preferably coacting gear teeth.

According to another aspect of the invention, a prior art display may be modified or retrofit to better operate with the method or apparatuses of the invention by applying to it a sleeve that has wheel engagement surface, e.g., gear-like teeth thereon.

Other objects and advantages of the invention herein will become apparent in the specification below.

BRIEF DESCRIPTION OF THE DRAWINGS

FIG. 11 is a perspective view of an alternate embodiment of the present invention.

FIG. 12 is a cross-sectional elevational view of an embodiment of a retrofit system of the invention.

DETAILED DESCRIPTION OF THE PREFERRED EMBODIMENT

Figure 1:
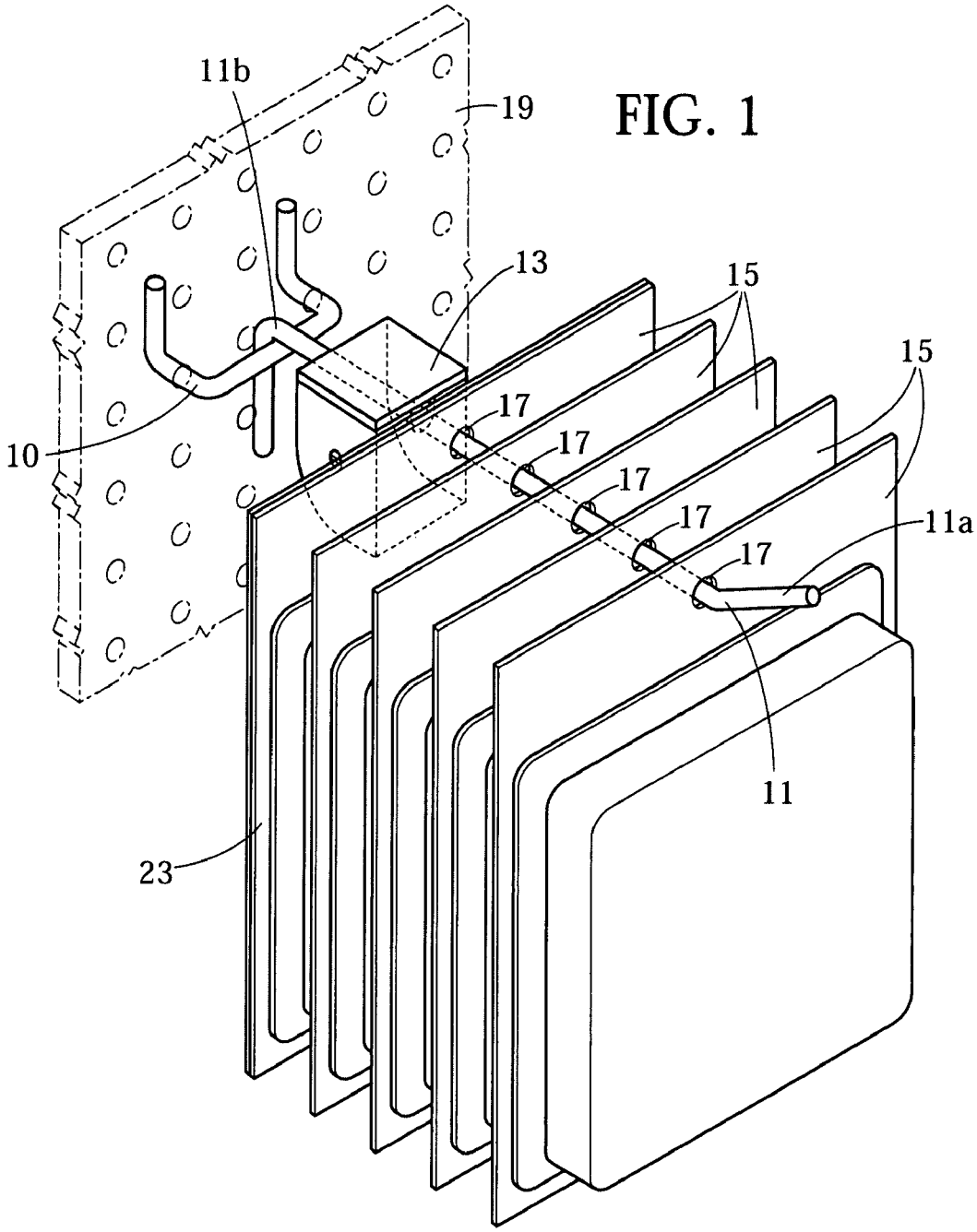
FIG. 1 is a perspective view of an embodiment of the present invention.
Figure 2:
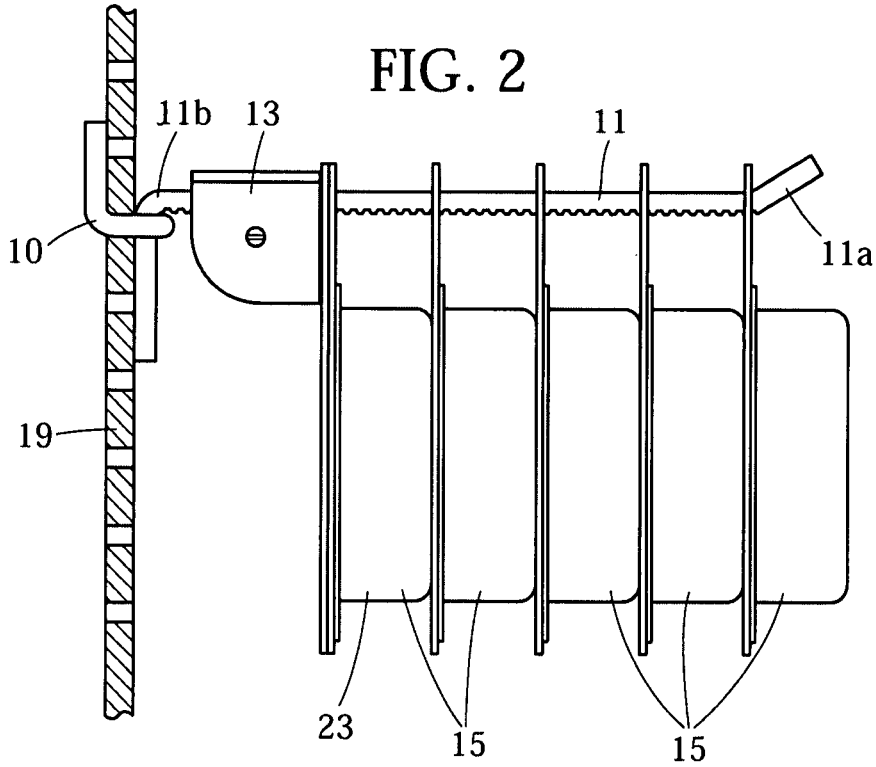
FIG. 2 is a side view of an embodiment of the present invention as it might be initially stocked with packaged retail items.
Figure 4:
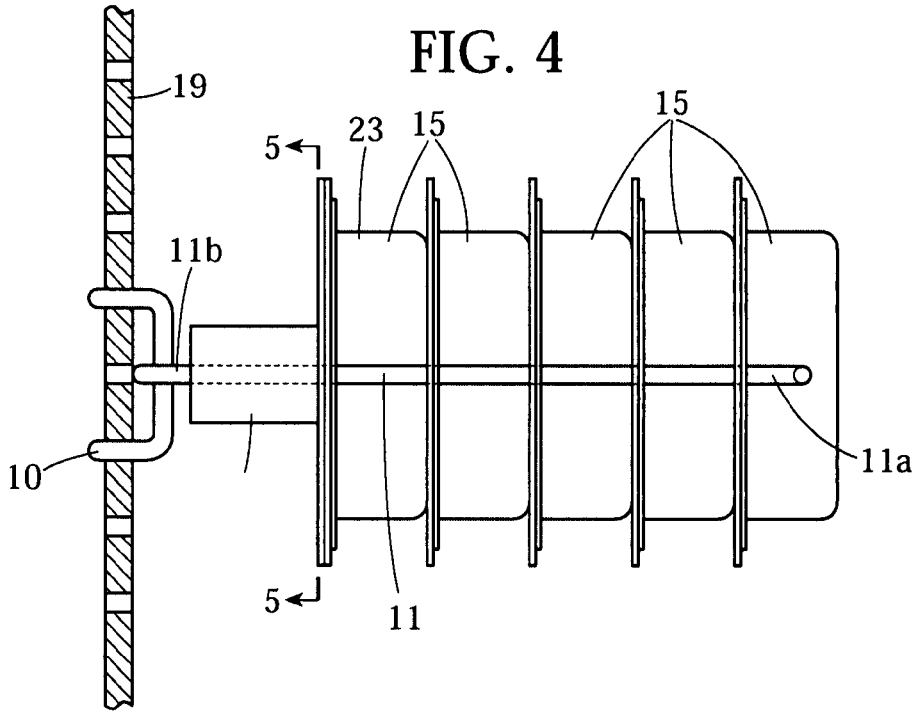
FIG. 4 is a plan view of FIG. 2.

As best seen in FIGS. 1, 2 and 4, a product pushing device 13 is positioned along the length of an elongate support member, hook or rod 11 that supports various packaged products 15. The packaged products 15 are typically suspended from the rod 11 from a hole 17 located near the top and in the center of the packaging 15. The rod 11 is secured by a mounting structure 10 on its proximal end 11*b* to and protrudes generally horizontally from a back display wall or pegboard panel 19. The front end 11*a* of the rod 11 distal from the panel 19 is bent upwards to provide a resistance to prevent the packaged products from slipping forward and falling off the rod 11.

As consumers remove packaged products from the front end 11*a* of the rod 11, the product pushing device 13 moves the remaining packages of merchandise items 15 in a forward direction, i.e., from the end of the rod secured to the wall 11*b* to the front distal end of the rod 11, by applying a pushing force on the rear face of the last product 23, i.e., the product that is closest rearward to the wall or pegboard 19. However, because the entire length of the rod has been loaded with suspended products 15, the pushing device 13 is positioned at the back end 11*b* of the rod 11.

The pushing force of the pusher device 13 is such that the packages 15 on the rod are pushed forward to the distal end of the rod 11 progressively and continuously as packages 15 are removed from the end of the rod 11*a*.

Figure 3:
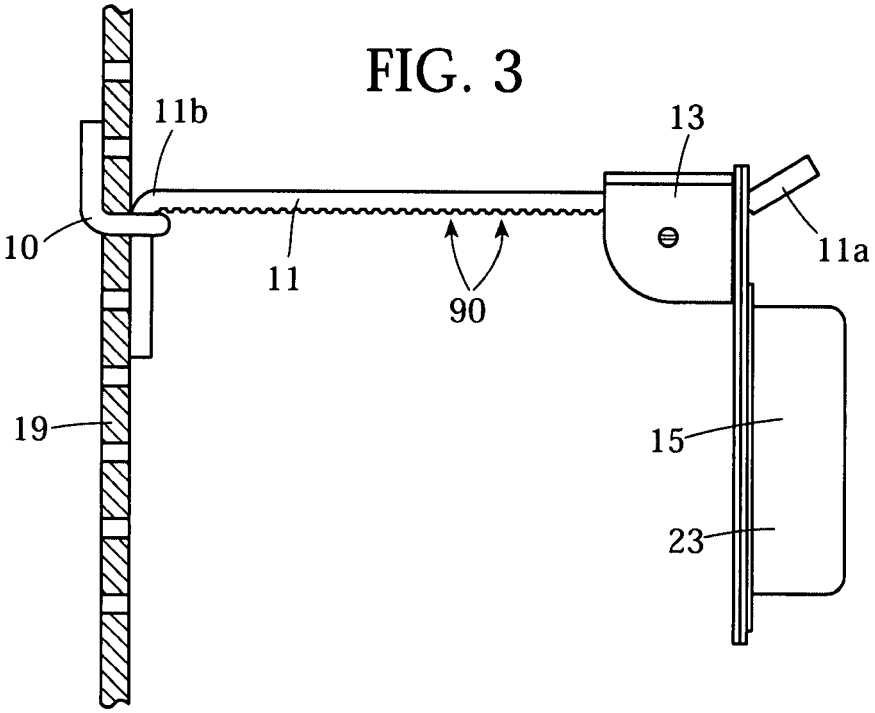
FIG. 3 is a side view of an embodiment of the invention after all but one of the packaged retail items have been removed.

FIG. 3 shows a side view of an embodiment of the invention after all but one of the packaged retail items 23 has been removed from the front end 11*a* of the rod 11. In this scenario, the pushing device 13 has continually moved forward as packages have been removed from the end of the rod 11*a*, and is now located at the front end of the rod 11*a*. As a result, although four other packages in front have been removed and only one package 23 remains hanging from the rod 11, the package 23 is positioned on the front end of the rod 11*a*. Although the pusher may continue to apply a forward pushing force on the rear face of the package 23, both the pusher 13 and the package 23 remain on the rod due to the upward configuration at the front of the rod 11*a*, which prevents articles from falling off the rod and the fact that the force that is applied by pusher 13 is not great enough to push the package product 23 over the resistance of the upwardly extending end structure 11*a* of the rod 11. In addition, the pusher 13 has a limit of travel on the rod forward due to the teeth of its engagement mechanism with the rod 11, in that the pusher cannot move forward beyond the teeth on rod 11, which also prevents the pusher from pushing the last package 23 off the end of the rod 11.

Figure 5:
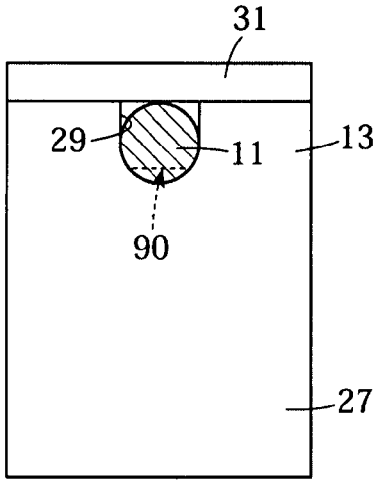
FIG. 5 is a detail sectional view along line 5-5 of FIG. 4.

FIG. 5 shows a front view of the pusher unit 13. This is the face of the pusher 13 that contacts the rearmost package on the rod 11. The pusher is assembled from a housing 27 through which rod 11 extends, passing through openings 29. Housing 27 includes a top plate 31 that covers the passage through which the rod 11 extends. Top plate 31 has a portion that rests on the rod 11 and may be provided with friction reducing material, e.g., Teflon™ or mechanical friction reducing systems to reduce drag as the pusher unit 13 moves reciprocally along the rod 11.

Figure 6:
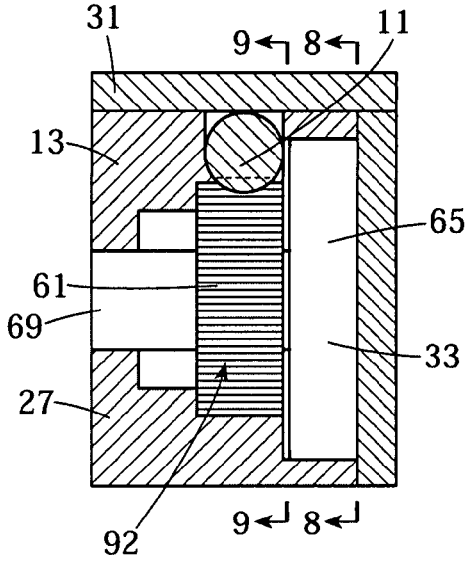
FIG. 6 is a view as in FIG. 5 with most of the housing cut away to show the inner workings of the pusher device.
Figure 8:
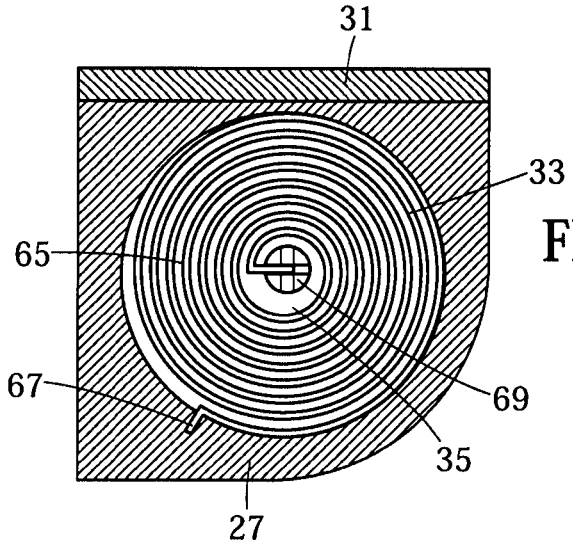
FIG. 8 is a detail section view along line 8-8 of FIG. 6.

As shown in the detailed elevational view of FIG. 6 and the cross-sectional view of FIG. 8, a wheel 61 is rotatably supported in housing 27 so as to maintain constant engagement with the rod 11. This wheel is preferably a standard commercially available gear wheel having gear teeth, sometimes referred to as a spur gear. The structure of the housing is such that the distance between the axis of rotation of the wheel 61 and the top of the rod 11 remains constant as the pusher device moves along the rod 11.

A center rotational shaft or pin 69 is fixedly mounted with and extends from the center of the wheel 61, so that the pin 69 rotates with the wheel 61. The pin 69 further extends through the center of a biasing element or force generating element 65. The element 65 is preferably a spring mechanism comprising a coil spring 33 secured in the housing 27 by an outer end, e.g., a radially projecting tongue 67 of the spring fixedly secured in a slot in the housing communicating with the spring space in the housing. The inner end of the spring 33 is fixedly attached to the shaft 69 of the wheel 61 by inserting a connection portion of the spring, such as a radially inward extending tongue 35 at the inner end thereof, into a slot in the shaft 69. Rotation of the shaft 69 causes the coil spring 33 to tighten or release, depending on the direction of the rotation.

Alternatively, the force generating element 65 comprises a coil spring assembly having an outer casing that is fitted and secured fixedly in the housing 27, the coil spring 33 attached to the inside of casing 67 and an inner sleeve or cylinder secured at the inside end of the coil spring 33. The sleeve is fixedly attached to the shaft or pin 69, so that the coil spring 33 wraps or unwraps around the sleeve and around the shaft 69 as the wheel 61 rotates.

As best seen in FIG. 5, which shows the embodiment displayed in FIG. 6 from a user's perspective, the outer housing 27 hides from view the coil spring assembly 67 and wheel component 61 of the pusher device 13, so that only the rod 11 and housing 27 of the apparatus 13 are visible when viewing the unit from the front end of the rod.

Figure 7:
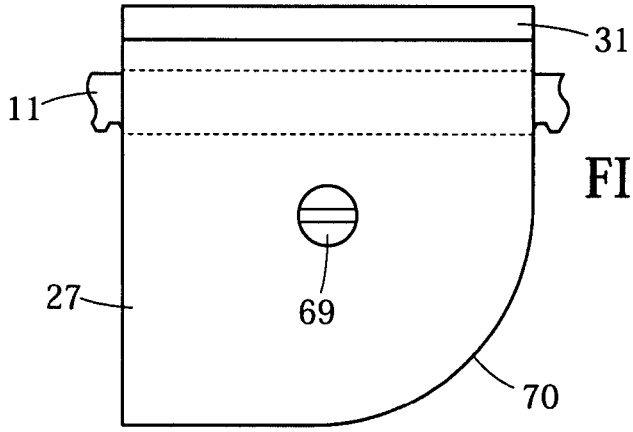
FIG. 7 is a side view of an embodiment of the present invention from outside the outer housing of the pusher device.

Similarly, FIG. 7 depicts a detail side view of the pusher apparatus from a user's perspective. The outer housing 27 hides the coil spring mechanism 33 and wheel 61 from view, so that only the rod 11 and the end of shaft or pin 69 are visible.

The coil spring mechanism 33 is a standard coiled flat spring or power spring oriented in the housing so that the coil is wound tighter or charged by the wheel 61 rolling along the rod 11 as the unit is pushed back from the front of the rod 11. As a result, the coil spring 33 when it tries to unwind turns the wheel 61 to roll along the rod 11 and urges the unit 13 to move toward the front end of the rod 11. The coil spring is selected so that the force that the pusher unit 13 applies as it is urged to the end of the rod 11 is such that it is capable of pushing the product hanging on the rod 11 to the front, but not so great a force that the product can be pushed completely off the distal end 11*a*. The amount of force that is appropriate is dependent on the weight of the product displayed, and accordingly the spring and/or wheel of pusher unit 13 must be preselected for a given application to have the correct amount of force. The force applied by the pusher unit 13 to the product preferably varies from about 0.5 pounds to about 5 pounds, depending on the application, e.g., the weight of the packages 23 on the display.

In addition, the coil spring is preferably a constant force spring, meaning that it produces the same amount of rotational force on the wheel 61 no matter how tightly it is wound or charged. Alternatively, however, it may be desirable to provide a variable force spring, also readily available on the market, which increases the force applied to the wheel 61 and by the pusher unit 13 the farther back the pusher unit 13 is moved and the tighter it is wound. The higher force likely corresponds to a greater weight of product to be pushed when the rod 11 is completely filled with product, as compared to less force expected necessary when the rod 11 supports only a small amount of product. In addition, a variable force spring may be adjusted in the force output by rotating the position of the spring as it is held in the housing 27.

Figure 9:
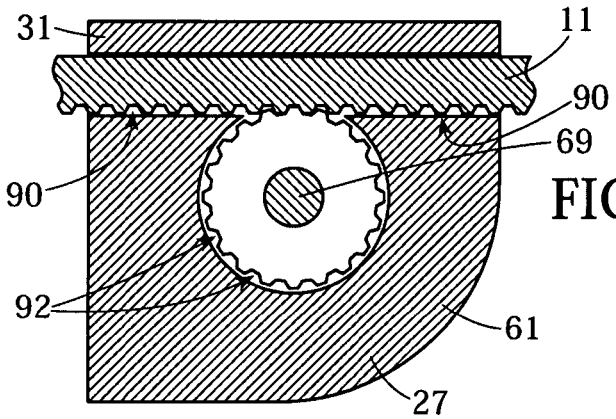
FIG. 9 is a detail section view along line 9-9 of FIG. 6.

As best seen in FIG. 7 to 9, in the preferred embodiment of the apparatus, the outer housing 27 is shaped in the form of a square with one rounded corner 70 that outlines the circumference of the coil spring 65. This particular configuration of the outer housing is aesthetically pleasing, and further requires less material to make than a completely square-shaped outer housing.

FIG. 8 depicts a detail section view along line 8-8 of FIG. 6, and shows the coil spring attached at an inner end to a sleeve 35 affixed to the shaft 69, which is fixedly connected with configured to rotate with the wheel 61. The coil spring mechanism is a self-contained unit comprising an outer casing 67 that fits into a conforming opening in the housing 27. Inside the outer casing 67, the outer end of the spring 65 is fixed to the outer casing 67, and coils radially inward inside the casing 67. The inner end of the coil spring 65 is fixedly secured to sleeve 35 so that rotation of the inner sleeve 35 relative to the outer casing 67 coils the spring tighter, charging the spring to bias the sleeve 69 to rotate relative to the outer casing 67 in the opposite direction. The sleeve 69 fixedly holds therein shaft 69 so that they rotate together, and shaft 69 is biased or urged to rotate. The coil spring 65 is in an arrangement or orientation such that the spring tightens as the inner end of the spring is wrapped around the shaft and sleeve 69 as the wheel traverses the rod 11 rearward, and so that the spring discharges and urges or biases the wheel to rotate and roll the wheel forward to the distal end of the rod 11.

FIG. 9 depicts a detail section view along line 9-9 of FIG. 6, and shows the wheel 61 moving along the rod 11. It is especially important the contact between the wheel 61 and the rod 11 be high friction so that the force from the spring is transmitted efficiently to move the pusher unit 13 forward. In the preferred embodiment of the pusher apparatus, the wheel 61 and the rod 11 have coacting engagement structures to accomplish this. The engagement structures take the form of coacting gear-like teeth, wherein teeth generally indicated at 90 on the rod correspond to teeth generally indicated at 92 on the wheel 61, so as to maximize friction between the wheel 61 and the rod 11 as the wheel 61 traverses the rod. In addition, the teeth 90, 92, allow for the wheel 61 to maintain constant engagement with the rod 11, and also prevent the pusher unit 13 from advancing off the rod 11 completely, because the teeth 90 in the rod 11 end at a point and jam lock the wheel 61.

Figure 10:
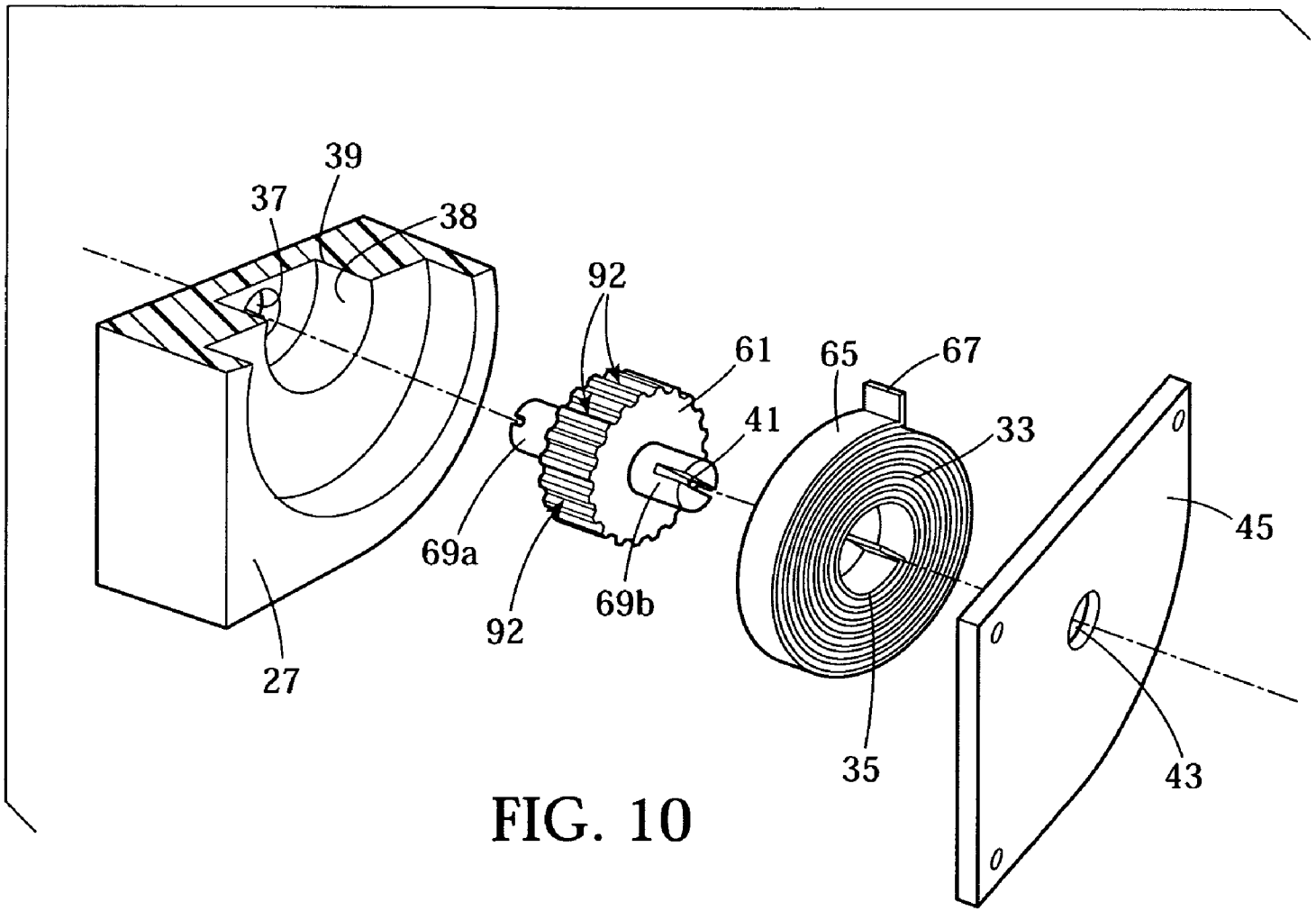
FIG. 10 is an exploded partially cut-away perspective view of the preferred embodiment of the present invention.

FIG. 10 depicts an exploded partially cut-away view of the preferred embodiment of the pusher device 13, having an outer housing 27 in the shape of a square with a rounded corner. Shaft 69 protrudes from either side of wheel 61 to which it is attached fixedly. Shaft end 69 a is rotatably received in aperture 37 in housing 27, and wheel 61 fits into space 38 in housing 27, which has a top opening 39 through which the wheel 61 contacts rod 11. Coil spring assembly 65 mounts on shaft end 69*b*, with the inner connection portion tongue 35 fixedly secured in slot 41 in shaft 69. The extreme end of pin 69*b* is rotatably received in aperture 43 in end cover plate 45.

The parts of the pusher device, especially the spring mechanism, which is made of metal, and the gear wheel, are preferably situated in the housing such that the center of gravity of the pusher device is below the rod or hook 11 so that the weight of the pusher device effectively maintains it in a stable position relative to the rod and the wheel stays in contact with the traction engagement surface or teeth of the underside of the rod.

A certain amount of frictional force or transmitting engagement force between the surface of the rod and the wheel must be maintained in order for the pusher device to be able to push products forward along the rod. For stores which are hesitant to acquire a new set of rods having the requisite surface to co-act with the wheel of the pusher device, such as gear-type teeth, another embodiment of the invention includes a retrofit sleeve that is configured so as to fit around a standard rod and provide the requisite frictional force between the surface of the sleeve and wheel so as to push products forward on the rod.

As depicted in FIG. 11, an alternate embodiment of the pusher device 101 is shown operating with a standard-issue rod 103, which is provided with a retrofit sleeve 105 that is configured to grip the length of the rod 103 so as to remain fixed as the pusher apparatus 101 traverses the length of the sleeve 105, thereby pushing the packaged products 107 towards the front end of the rod 108.

Figure 13A:
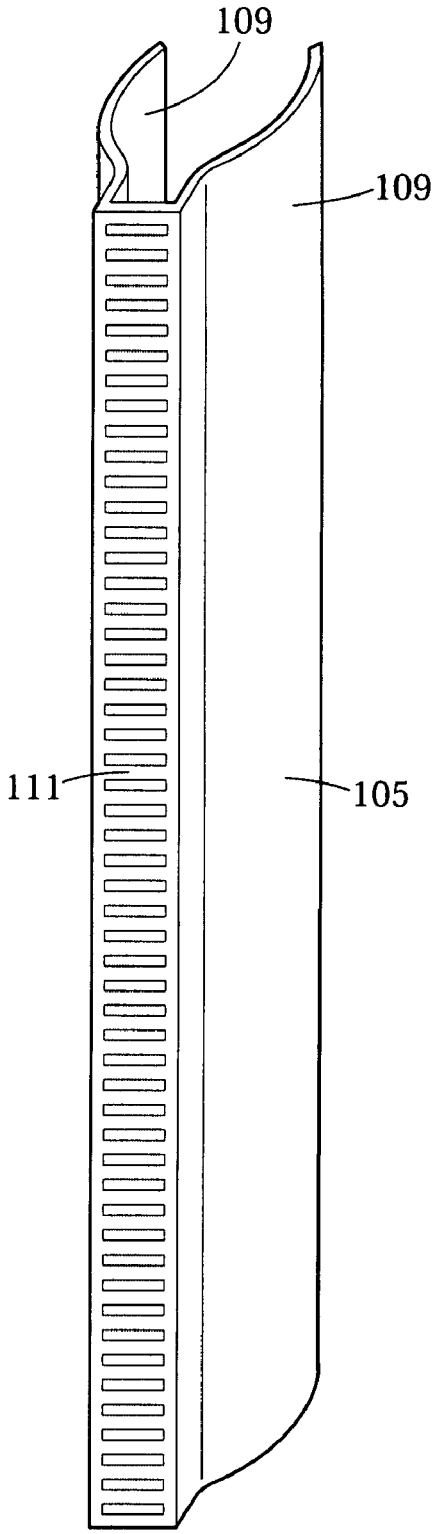
FIG. 13A is a perspective view of the outer sleeve of the retrofit apparatus of the present invention.

As best seen in FIG. 13A, the retrofit sleeve 105 is configured to snap into place around a standard display hook rod by two curved portion 109 that extend upwardly from a molded track 111 of gear teeth sized to coact with the gear toothed wheel of the pusher unit 101. The entire sleeve is preferably made in plastic, and is dimensioned to fit through the standard product packaging hole 113 (see FIG. 12) when placed on a rod 103.

Figure 13B:
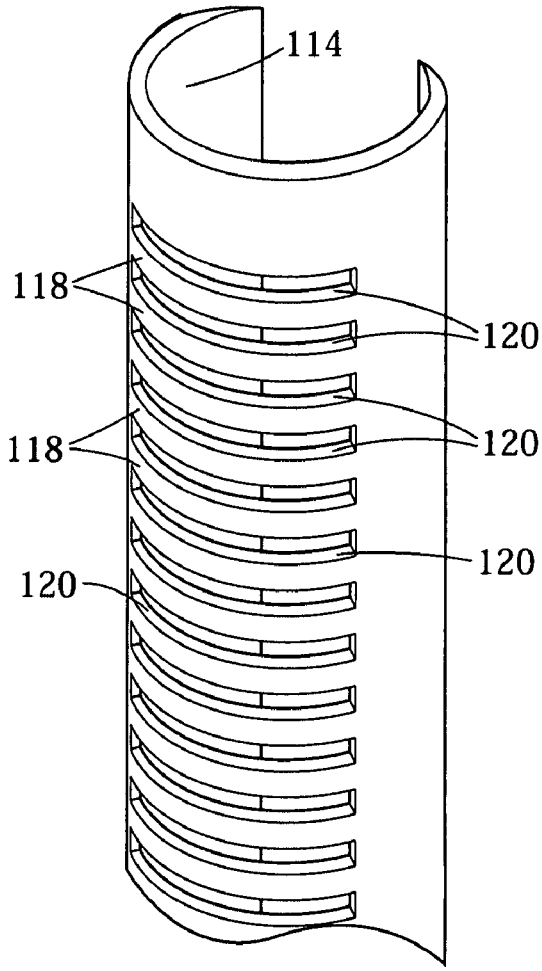
FIG. 13B is a detail perspective view of an alternate embodiment of the outer sleeve of a retrofit apparatus.

FIG. 13B discloses an alternate embodiment of the sleeve 114, which also is a molded plastic part that is configured to snap on securely to the rod 11. The track 116 has coacting teeth 118 defined by recesses 120 formed in the sleeve 114.

Figure 14:
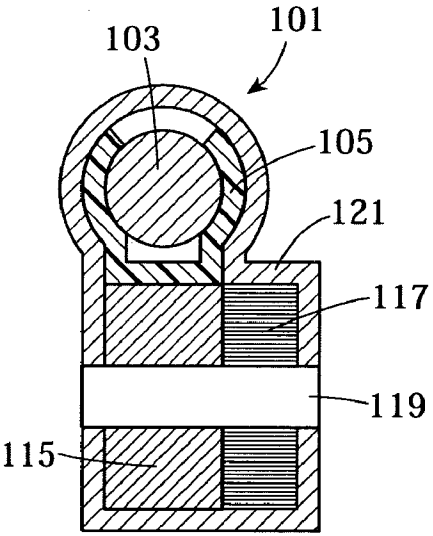
FIG. 14 is a cross-sectional view of an embodiment of a retrofit apparatus of the present invention.

Pusher apparatus 101 contains a similar coil spring and gear wheel to the previous embodiment, and works in a similar way. As best depicted in FIG. 14, the pusher unit 111 contains the gear-toothed wheel 115 and the coil spring 117 both mounted on axle shaft 119 positioned below the rod 103 within housing 121.

Figure 15:
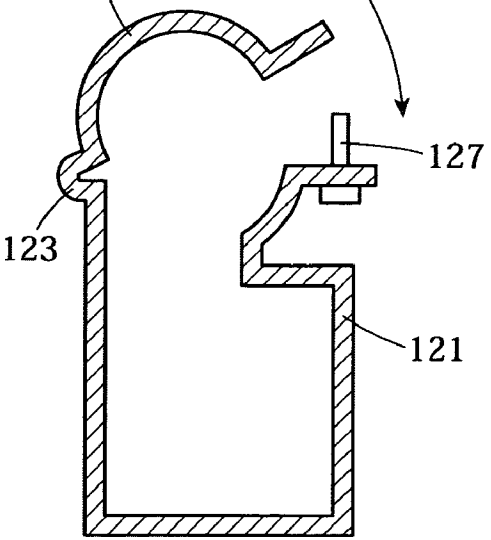
FIG. 15 is a cross-sectional view of a hinged outer housing which can be used in the present invention.

FIG. 15 depicts a further an aspect of the embodiment in which the housing 121 has a hinge 123, which allows the pusher device 101 to easily be opened and closed for installation or assembly. The hinged top 125 is secured when closed by bolt or rivet 127.

Figure 16:
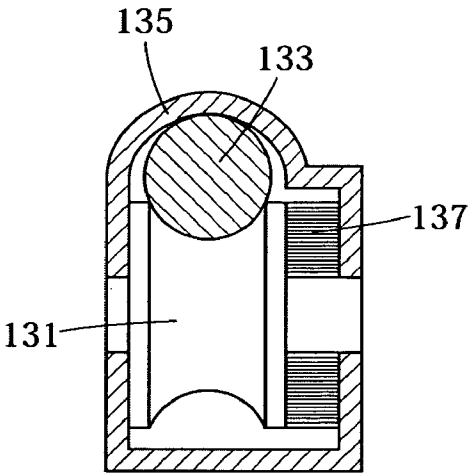
FIG. 16 is an elevational view of the cross-section of the embodiment of the present invention in which the wheel is rubber.

FIG. 16 depicts a further embodiment of the present invention in which the wheel 131 is made out of rubber, or some other material having a high coefficient of friction, or else has at least a contact surface of such a material for the rod 133, so as to maintain the requisite frictional force between the rod 133 and the wheel 131 to move the pusher unit 135 forward based on the force generated by coil spring 137.

Figure 17:
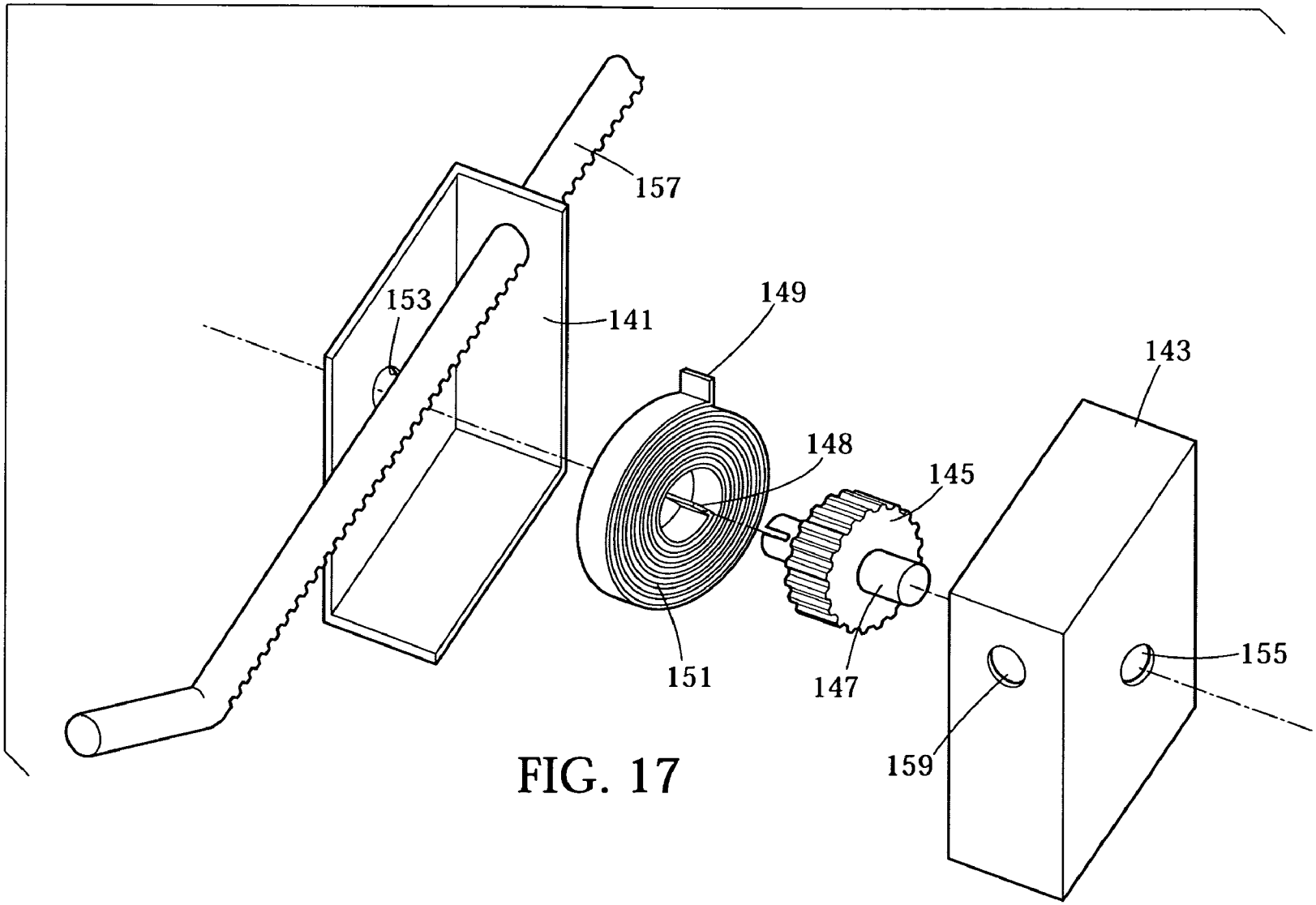
FIG. 17 is an exploded perspective view of an embodiment of the present invention with a simplified two piece housing design.

FIG. 17 is an exploded view of yet another embodiment of the invention, in which the outer housing is of two three faced parts 141 and 143. Gear toothed wheel 145 is mounted on a pin 147 with a slot that receives and holds secured fixedly the inner end tongue 148 of coil spring assembly 151.

During assembly, the housing parts are placed over the rod 157 so that the rod 157 extends through openings 159. The two parts 141 and 143 are then assembled so that the lateral ends of pin 147 extend through openings 153 and 155 in the housing parts 141 and 143. Wheel 145 automatically aligns with the teeth of rod 157. The coil spring assembly 151 is immobilized in the housing by a portion of the housing (not shown) that receives the outer tongue 149 of spring with a portion or portions in the housing part 141.

Figure 18:
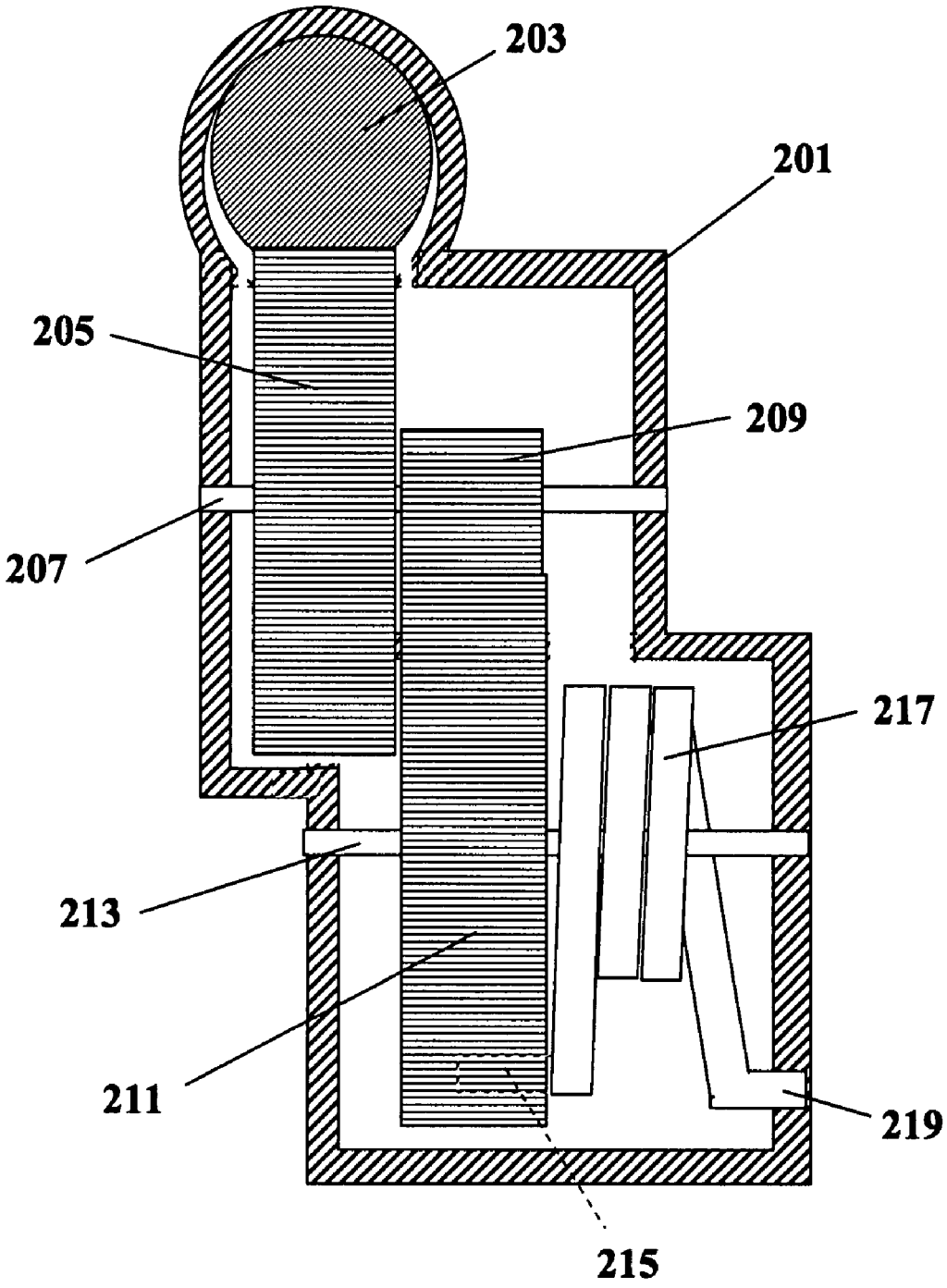
FIG. 18 is a cross sectional view as in FIG. 6 showing the inner workings of a pusher device of an alternate embodiment.

FIG. 18 shows a particularly advantageous alternate embodiment of the invention. An external housing 201, configured to contain the mechanism depends on the hook rod 203 as the above embodiments do. A first gear wheel 205 is fixedly secured on rotatable shaft 207 and engages the teeth on the bottom of the rod 203. Alternatively, a flat friction roller or a retrofit sleeve with teeth may be used on the rod, as discussed herein previously. A step-up gear wheel 209 is also fixedly secured on shaft 207 so as to rotate therewith, and so that both toothed gear wheels 205 and 209 are constrained to turn together.

Gear wheel 209 has teeth that meshingly engage with the teeth of toothed gear wheel 211, which is supported for rotation on shaft 213 in housing 201. Gear wheel 211 is connected with one end 215 of torsion spring 217, the other end 219 of which is secured in the housing 201. Rotation of wheel 211 in one direction tightens the spring 217, and the spring 217 biases the wheel to turn in the other direction.

When housing 201 is pushed to the back of the rod 203, it rotates wheel 205 together with gear wheel 209. Gear wheel 209 in turn rotates wheel 211, which tightens spring 217. As product is removed from the rod 203, the force from spring 217 is transmitted to wheel 211, to wheel 209, to wheel 205, resulting in a force urging the housing 201 forward on the rod 203.

The torsion spring 217 usually has a limited operative range of motion of about 360 degrees, and the usual rod 203 is of a length that several turns of the wheel 205 are needed to roll the pusher to the forward end of the rod. The step-up wheel 209 serves to convert the 360 degrees of discharge rotation of spring 217 transferred to wheel 211 into several rotations, preferably four, of the wheel 205. The force constant of the spring is selected such that the force conferred to the rod 203 is appropriate so as to move the product forward without pushing it off the rod 203.

It will be understood that the invention herein extends well beyond the embodiments of the disclosure, and the terms used in this specification should be understood to be language of description, not limitation, as those of skill in the art with this specification before them will be able to make changes and modifications therein without departing from the spirit of the invention.

What is claimed is:

1. A display apparatus comprising:

an elongate rod configured to support a plurality of packaged products thereon;

said rod having a proximal end secured to a fixed display surface and extending generally horizontally and forwardly therefrom, and a distal end; and a product pusher device movably supported on the rod for forward and rearward movement therealong;

said product pusher device having a biasing mechanism therein that engages the rod and applies a relative force thereto from the pusher device such that said product pusher device engages a rearmost one of the plurality of packaged products and applies a pushing force thereto so as to move the packaged products forward towards the distal end of the rod;

said biasing mechanism being completely supported in the product pusher device and moving therewith on the rod;

said rod having an outer surface with an upwardly disposed upper surface portion configured to slidingly support the packaged products thereon so that said packaged products are suspended from the rod and are able to slide thereon, the product pusher device engaging with and being wholly supported on the outer surface of the rod and moving in its entirety along the rod so as to push the packaged products forward on the rod.

2. The display apparatus of claim 1, wherein said biasing mechanism comprises:

a wheel rotatably supported in the product pusher device so as to engage with said rod and to rotate when the product pusher device moves along said rod, and a biasing element supported in the product pusher device, said biasing element being connected with the wheel so as to urge said wheel to rotate so as to move the pusher device forward relative to the rod.

3. The display apparatus of claim 2, wherein the biasing element comprises a spring having a first portion thereof fixedly connected with a housing of the pusher device, and a second portion thereof connected with said wheel so that the spring is charged when the pusher device is moved rearward and the spring urges the wheel to rotate to move the pusher device forward on the rod.

4. The display apparatus of claim 3, wherein said wheel and said spring are enclosed in the housing of the pusher device.

5. The display apparatus of claim 3, wherein said spring is a constant force coil spring.

6. The display apparatus of claim 3, wherein said spring is a variable force coil spring and the wheel being urged by a greater force as the pusher device is moved rearward on the rod.

7. The display apparatus of claim 2, wherein said wheel is positioned below said rod.

8. The display apparatus of claim 2, wherein said wheel and said rod have coacting engagement structures that provide for transmission of force from the wheel to the rod.

9. The display apparatus of claim 8, wherein said coacting engagement structures comprise complementary gear-type teeth on the wheel and on the rod.

10. The display apparatus of claim 1, wherein said rod has a generally circular cross-section, and the distal end has an upwardly extending portion resisting sliding of the products off the distal end thereof.

11. A product display system comprising:

a rod structure having an upper surface adapted to have products on display suspended thereon so as to slide forward and backward on the upper surface;

a pushing device comprising:

a housing having the rod structure extending therethrough and resting movably on the upper surface of the rod structure so as to move forward and backward thereon;

a wheel rotatably supported in said housing in a position such that said wheel is in constant engagement with the rod structure; and a force generating element completely supported in the housing and connected with said wheel so as to urge the wheel to rotate in a direction and to move the housing forward on the rod structure, said force generating element moving in its entirety with said housing on the rod structure.

12. The system of claim 11, wherein the force generating element is a spring, and a first portion of said spring is fixedly connected with said housing, and a second portion of said spring is connected with the wheel so that the spring biases the wheel to rotate.

13. The system of claim 12, wherein said spring is charged when the wheel is rotated in a direction consistent with rearward movement of the housing.

14. The system of claim 13, wherein said spring is a constant-force spring.

15. The system of claim 13, wherein said spring is a variable force spring that exerts a greater force on the wheel the more said spring is charged.

16. The system of claim 11, wherein said wheel is positioned below said rod structure and the housing includes an engagement portion above and engaging and resting on the upper surface of the rod structure so as to support the housing to be slidable on the upper surface of the rod structure, said engagement portion being such that friction created between the engagement portion and the upper surface of the rod structure is less than the force applied to the rod structure by the wheel.

17. The system of claim 11, wherein said wheel has gear teeth thereon configured to coact with teeth on the rod structure.

18. A method for displaying products configured for hanging display, said method comprising:

providing an elongate member comprising a rod extending generally horizontally and having an upper surface configured to support the products hanging thereon, said rod having a proximal end fixedly supported on a back wall of the display and a forwardly projecting distal end having a structure configured to provide a resistance to products sliding off said rod at said distal end, said upper surface being smooth such that that the products hanging on the rod are slidable on the upper surface toward and away from the back wall of the display;

providing a pusher device engaging with and being supported on the upper surface of the rod so as to be movable along said rod behind the products hanging on the rod, said pusher device having a housing rotatably supporting a wheel in constant engagement with said rod and a coil spring connected with said wheel so as to apply a rotational force to the wheel that causes the wheel to roll along the rod in a forward direction towards the distal end of the rod, said coil spring being charged when the pusher device is pushed back on the rod elongate-member away from the distal end, both said wheel and said coil spring being completely contained in and moving with said housing:

pushing the pusher device on the rod back away from the distal end and loading the products onto the rod between the pusher device and the distal end;

said rotational force applied to the wheel by coil spring of the pusher device being selected such that the wheel moves the pusher device forward and engages a rearmost of said products and pushes all of the products on the rod forward until a foremost of the products engages the structure of the distal end that provides said resistance, and such that the pusher device does not impart a force to said foremost product sufficient to overcome the resistance of the distal end and push the foremost product off the rod.

19. The method of claim 18, wherein said spring has a first portion fixedly attached to a casing retained fixedly in said housing, and a second portion fixedly attached to an inner casing fixedly connected said wheel.

20. The method of claim 18, wherein said upper surface of the rod is generally circular.

21. The method of claim 18, wherein said spring is a constant force spring.

* * * * *